US011933015B2

(12) United States Patent
Rosenpek et al.

(10) Patent No.: US 11,933,015 B2
(45) Date of Patent: Mar. 19, 2024

(54) LOADER VEHICLE

(71) Applicant: VOLVO CONSTRUCTION EQUIPMENT AB, Eskilstuna (SE)

(72) Inventors: Norbert Rosenpek, Växjö (SE); Johan Ohlsson, Katrineholm (SE)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 879 days.

(21) Appl. No.: 16/067,454

(22) PCT Filed: Jan. 22, 2016

(86) PCT No.: PCT/SE2016/050042
§ 371 (c)(1),
(2) Date: Jun. 29, 2018

(87) PCT Pub. No.: WO2017/127002
PCT Pub. Date: Jul. 27, 2017

(65) Prior Publication Data

US 2019/0003147 A1 Jan. 3, 2019

(51) Int. Cl.
*E02F 3/28* (2006.01)
*E02F 9/08* (2006.01)

(52) U.S. Cl.
CPC ..... *E02F 3/283* (2013.01); *E02F 9/0841* (2013.01); *E02F 9/0875* (2013.01)

(58) Field of Classification Search
None
See application file for complete search history.

(56) References Cited

U.S. PATENT DOCUMENTS

| | | | | |
|---|---|---|---|---|
| 3,720,332 | A | 3/1973 | Molby | |
| 3,937,345 | A | 2/1976 | Countryman | |
| 8,186,154 | B2 | 5/2012 | Nelson et al. | |
| 8,453,785 | B2 | 6/2013 | Kisse et al. | |
| 8,683,793 | B2 | 4/2014 | Bergstrom et al. | |
| 10,704,231 | B1 * | 7/2020 | Lizuka | E02F 9/16 |
| 2013/0313398 | A1 | 11/2013 | Sayre et al. | |
| 2014/0360354 | A1 * | 12/2014 | Kurushima | E02F 9/2012 92/145 |

(Continued)

FOREIGN PATENT DOCUMENTS

| | | | |
|---|---|---|---|
| CN | 201195851 | Y | 2/2009 |
| CN | 201305864 | Y | 9/2009 |

(Continued)

OTHER PUBLICATIONS

Extended European Search Report for European Application No. EP 16886675.4, dated Sep. 19, 2019, 7 pages.

(Continued)

*Primary Examiner* — Michael S Lowe
(74) *Attorney, Agent, or Firm* — Sage Patent Group

(57) ABSTRACT

A loader vehicle includes a front unit and a rear unit pivotally connected to each other by an articulated joint arrangement allowing mutual rotation of the front unit and the rear unit. The loader vehicle includes a loading unit assembly and a control valve arrangement arranged to hydraulically control the loading unit assembly, wherein the control valve arrangement is arranged at a rear portion of the front unit in the vicinity of the articulated joint arrangement.

16 Claims, 4 Drawing Sheets

(56) References Cited

U.S. PATENT DOCUMENTS

| | | | | |
|---|---|---|---|---|
| 2015/0218779 | A1 | 8/2015 | Mitchell et al. | |
| 2015/0246612 | A1 | 9/2015 | Velde et al. | |
| 2016/0252192 | A1* | 9/2016 | Sheehan ..... | F16C 11/069 251/231 |

FOREIGN PATENT DOCUMENTS

| | | | |
|---|---|---|---|
| CN | 101668900 | A | 3/2010 |
| CN | 101680208 | A | 3/2010 |
| DE | 112015000090 | T5 | 3/2016 |
| EP | 0737612 | A2 | 10/1996 |
| FR | 1476231 | A | 4/1967 |
| GB | 1330402 | A | 9/1973 |
| JP | H11159836 | A | 6/1999 |
| WO | WO 98/02619 | A1 | 1/1998 |
| WO | 2014098652 | A1 | 6/2014 |

OTHER PUBLICATIONS

International Search Report (dated Oct. 21, 2016) for corresponding International App. PCT/SE2016/050042.

Chinese First Office Action dated Sep. 2, 2020 for Chinese Patent Application No. 201680079403.7, 10 pages (including English translation).

* cited by examiner

LOADER VEHICLE

BACKGROUND AND SUMMARY

The present invention relates to a loader vehicle, in particular a loader vehicle comprising a front unit and a rear unit pivotally connected to each other by a joint arrangement, i.e. a so-called articulated loader vehicle, wherein the front unit comprises a loading unit assembly having an implement for loading operations. The invention is however also applicable for other vehicles having articulated frame steering.

In the field of heavy vehicles, working machines in the form of e.g. articulated loader vehicles such as wheel loaders are frequently used at construction sites or the like. These articulated loader vehicles often comprise hydraulically operated arrangements, such as e.g, hydraulic cylinders, to control the operation of equipment associated with the loader vehicle. For example, a wheel loader comprises a bucket which is arranged on a loading unit, such as e.g. a lift arm. The loading unit is in turn pivotally connected to the loader vehicle. Hereby, lifting and lowering of the bucket relative to a ground surface is possible by means of pivoting the loading unit, Lifting the bucket is controlled by means of at least one hydraulic lift cylinder, and at least one hydraulic tilt cylinder is arranged to tilt the bucket relative to the loading unit. The hydraulic cylinders are hydraulically connected to a hydraulic pump arrangement which distributes hydraulic fluid to the hydraulic cylinders, and a hydraulic fluid tank arrangement which receives hydraulic fluid from the hydraulic cylinders. The distribution of hydraulic fluid to/from the hydraulic cylinders is often controlled by means of a control valve arrangement.

The control valve arrangement is thus arranged to receive control signals from the operator of the loader vehicle, which control signals indicate that the bucket should be lifted, lowered and/or tilted relative to a ground surface thereof.

In prior art solutions, the control valve arrangement is often arranged in the front area of a front unit of the loader vehicle. In detail, the control valve arrangement is often positioned between two lift arms of a loading unit assembly. However, as loader vehicles continue to develop, there is a desire to further improve the loader vehicle operation capabilities.

It is desirable to provide a loader vehicle comprising a control valve arrangement enabling for improved loader vehicle operation capabilities in comparison to the prior art.

According to a first aspect of the present invention, there is provided a loader vehicle comprising a front unit and a rear unit pivotally connected to each other by an articulated joint arrangement allowing mutual rotation of the front unit and the rear unit, the loader vehicle comprising a loading unit assembly and a control valve arrangement arranged to hydraulically control the loading unit assembly, wherein the control valve arrangement is arranged at a rear portion of the front unit in the vicinity of the articulated joint arrangement.

The control valve arrangement should thus in the following and throughout the entire description be interpreted as a valve arrangement controlling lifting and tilting motions of the loading unit assembly. When, for example, the loading unit assembly comprises an implement in the form of a bucket, the control valve arrangement is arranged to control lifting and lowering of the bucket relative to the ground surface, as well as tilting the bucket to e.g. release a load, etc. The control valve arrangement can also control and manoeuvre additional functionalities attached to the loading unit as well, such as e.g. gripping of gripping tool, etc., According to an example, the loading unit assembly may be a lift arm assembly.

Furthermore, the wording "in the vicinity of" should be understood to mean a position on the front unit at or close to the articulated joint arrangement. As defined above, the control valve arrangement is thus arranged on the rear portion of the front unit in front of the articulated joint arrangement as seen in the longitudinal (forward driving) direction of the loader vehicle. The control valve arrangement is preferably arranged at a rear portion of a frame section of the front unit. Further detailed example embodiments of the positioning of the joint arrangement will be given below.

An advantage of the present invention is that an improved accessibility to the control valve arrangement is provided in comparison to prior art solutions arranging the control valve arrangement at a front portion of the front unit since there is no need to raise the loading unit assembly to gain access to the control valve arrangement. Also, in comparison to positioning the control valve arrangement at the rear unit, the present invention provides simplified hydraulic routing of the hydraulic conduits which reduces the risk for wear of these relatively exposed components.

Furthermore, by arranging the control valve arrangement at the rear portion of the front unit enables for implementation of a single boom lift arm which will be described further below. The prior art position of the control valve arrangement at the front portion of the front unit prevents for the use of a single boom lift arm since a single boom lift arm operates within the area at the front portion of the front unit for lifting and lowering thereof.

According to an example embodiment, the articulated joint arrangement may comprise an upper and a lower attachment point at the rear portion of the front unit, wherein the control valve arrangement is arranged between the upper and lower attachment points.

The wording "between the upper and lower attachment points" should be understood to mean in the vertical direction of the loader vehicle. Hence, the control valve arrangement may be arranged at a position vertically between the upper and lower attachment points of the articulated joint arrangement.

Hereby, a relatively protected area for the control valve arrangement is provided. Also, the area between the upper and lower attachment points is accessible for e.g. service or maintenance of the control valve arrangement.

According to an example embodiment, the control valve arrangement may be at least partly housed within a frame section of the front unit.

Hereby, an advantage is that the control valve arrangement is further protected from e.g. external damage that may accidentally occur in the relatively rough environment at which the loader vehicle operates. The control valve arrangement may thus be protected from external damage by means of a frame section of the front unit.

According to an example embodiment, the loading unit assembly may be connected to the front unit by means of at least one lift arm joint arrangement, wherein at least a portion of the control valve arrangement is arranged behind the at least one lift arm joint arrangement as seen in the forward driving direction of the loader vehicle.

Hereby, an advantage is that the mass distribution of the loader vehicle is improved since more mass is located further away from a front wheel axle of the front unit. This will in turn give an increased lifting capacity of the loader vehicle. The at least one lift arm joint arrangement may preferably be arranged on a frame section of the front unit.

According to an example embodiment, the complete control valve arrangement may be arranged behind the at least one lift arm joint arrangement as seen in the forward driving direction of the loader vehicle.

According to an example embodiment, the articulated joint arrangement may constitute a substantially vertical geometric axis for allowing mutual rotation of the front unit and the rear unit.

According to an example embodiment, at least a portion of the control valve arrangement may be arranged between the at least one lift arm joint arrangement and the substantially vertical geometric axis as seen in the longitudinal direction of the loader vehicle.

According to an example embodiment, the complete control valve arrangement may be arranged between the at least one lift arm joint arrangement and the substantially vertical geometric axis as seen in the longitudinal direction of the loader vehicle.

According to an example embodiment, the loading unit assembly may be arranged at a front portion of the front unit. Hereby, the vehicle operator has full visual control of the loading unit assembly which is hence arranged in front of a cabin at which the operator controls the loader vehicle.

According to an example embodiment, the loading unit assembly may comprise a single boom lift arm. The single boom lift arm may be designed as a box-like structure.

As described above, positioning the control valve arrangement at the rear portion of the front unit enables for the implementation of a single boom lift arm.

According to an example embodiment, the single boom lift arm may be arranged at a substantially central position of the front unit as seen in the transversal direction of the loader vehicle.

According to an example embodiment, the loading unit assembly may comprise at least one lift cylinder and at least one tilt cylinder for controlling motions of an implement of the loading unit assembly.

According to an example embodiment, the loader vehicle may comprise a power source for propelling the loader vehicle, wherein the power source is arranged on the rear unit of the loader vehicle.

According to an example embodiment, the front unit may comprise a pair of ground engaging members, the ground engaging members each comprising, an individually controlled propulsion motor.

The ground engaging members may, for example, be wheels of the loader vehicle. Hereby, each of the wheels of the front unit may be individually controlled which can increase the operating conditions of the loader vehicle, Hence, the loader vehicle may be able to drive in relatively rough terrain by means of individually controlled propulsion motors.

According to an example embodiment, the individually controlled propulsion motors may be electric propulsion motors. Electric propulsion motors are relatively environmentally friendly. Furthermore, using electric propulsion motors further enables for the positioning of the control valve arrangement at the rear portion of the front unit since these propulsion motors do not need a bulky propulsion shaft between a power source arranged at the rear unit and the pair of ground engaging members of the front unit, hi further detail, the control valve arrangement may thus be arranged in the vicinity of the articulated joint arrangement at a centre position as seen in the transversal direction of the loader vehicle, which position is normally occupied by a propulsion shaft.

According to an example embodiment, the individually controlled propulsion motors may be individual wheel hub motors. Similar to the above described electric propulsion motors, individual wheel hub motors do not need a bulky propulsion shaft extending from the power source arranged at the rear unit of the loader vehicle, to the wheels of the front unit. Thus, the control valve arrangement may be arranged in the vicinity of the articulated joint arrangement at a centre position as seen in the transversal direction of the loader vehicle, which position is normally occupied by a propulsion shaft. Other types of propulsion motors are also conceivable, such as e.g. hydraulic propulsion motors.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional features and advantages of the present invention, will be better understood through the following illustrative and non-limiting detailed description of exemplary embodiments of the present invention, wherein.

DETAIL DESCRIPTION

Figure 1:
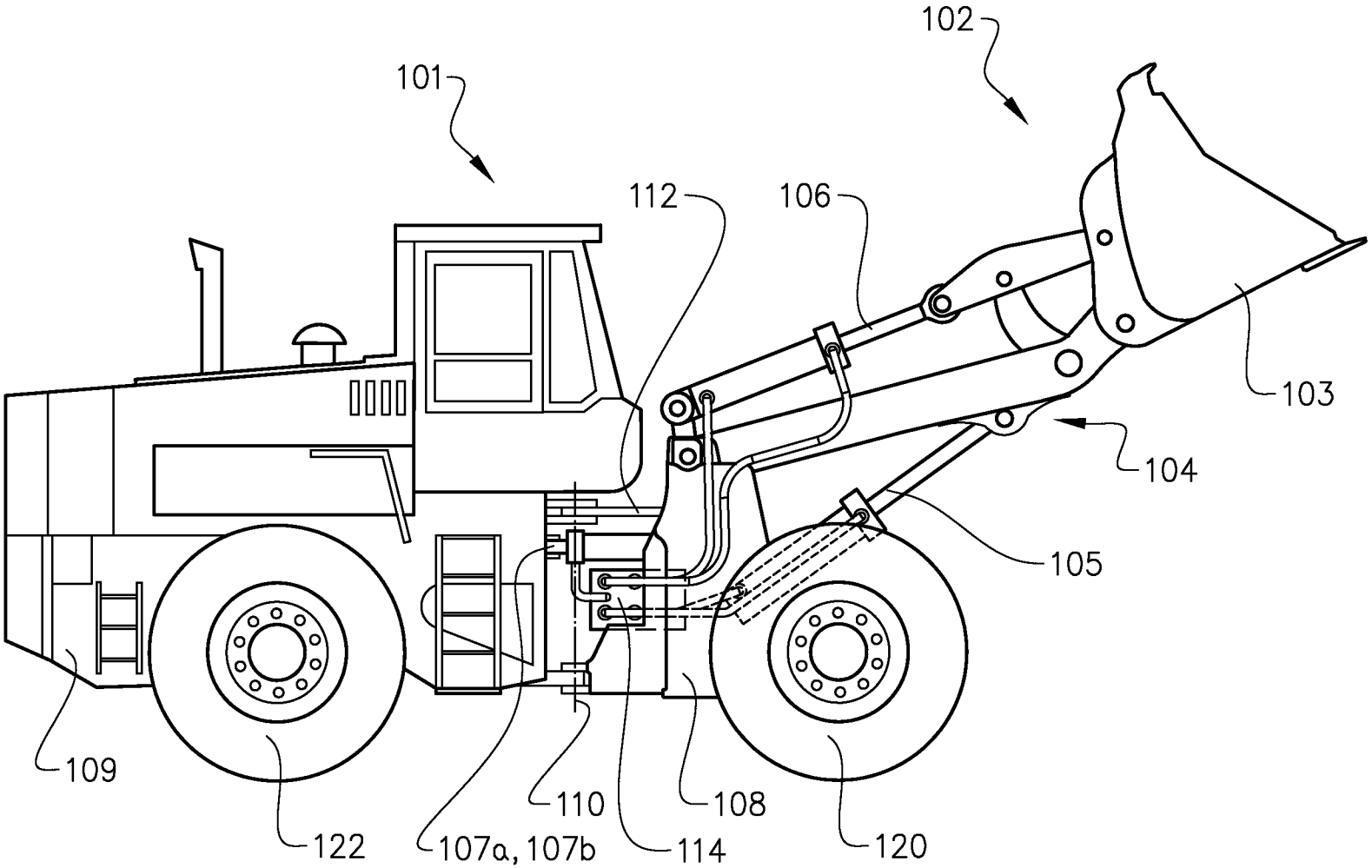
FIG. 1 is a lateral side view illustrating a loader vehicle in the form of an articulated wheel loader according to an example embodiment of the present invention.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

FIG. 1 is a lateral side view illustrating an example embodiment of a working machine in the form of a loader vehicle 101 having an implement 102 for loading operations. The loader vehicle 101 depicted in FIG. 1 is in the form of an articulated wheel loader. The term "implement" is intended to comprise any kind of hydraulically operated tool, such as a bucket, a fork or a gripping tool arranged on the loader vehicle 101L The implement 102 illustrated in FIG. 1 comprises a bucket 103 which is arranged on a loading unit assembly 104 for lifting and lowering the bucket 103. The bucket 103 can also be tilted or pivoted relative to the loading unit assembly 104. The loading unit assembly 104 comprises, as depicted in further detail in FIGS. 2 and 3, a single boom lift arm. The loader vehicle 101 is provided with a hydraulic system comprising at least one hydraulic machine (not shown), such as e.g. a hydraulic pump. The loader vehicle 101 further comprises a hydraulic lift cylinder 105*a*, for lifting operation of the loading unit assembly 104 and a hydraulic tilt cylinder 106 for tilting the bucket 103 relative to the loading unit assembly 104, The loader vehicle 101 also comprises a hydraulic tilt compensation cylinder 10*b* which operates in conjunction with the hydraulic tilt cylinder 106 for controlling the angular displacement of the bucket 103 relative to the ground surface when lifting and lowering the bucket 103. For simplicity of understanding, the hydraulic routing from the hydraulic tilt compensation cylinder 105*b* has been omitted. Furthermore, the hydraulic system comprises steering cylinders 107*a*, 107*b* for turning the loader vehicle 101 by means of relative movement of a front unit 108 and a rear unit 109 around a substantially vertical geometric axis 110 of an articulated joint arrangement 112. The front unit 108 and the rear unit 109 comprise a respective pair of ground engaging members 120, 122. The ground engaging members 120, 122 are in the example embodiment a respective pair of wheels. In other words, the loader vehicle 101 is frame-steered by means of the steering cylinders 107*a*, 107*b*. Furthermore, the loader vehicle 101 comprises a control valve arrangement 114 arranged at a rear portion of the front unit 108 in the vicinity of the articulated joint arrangement 112.

Figure 2:
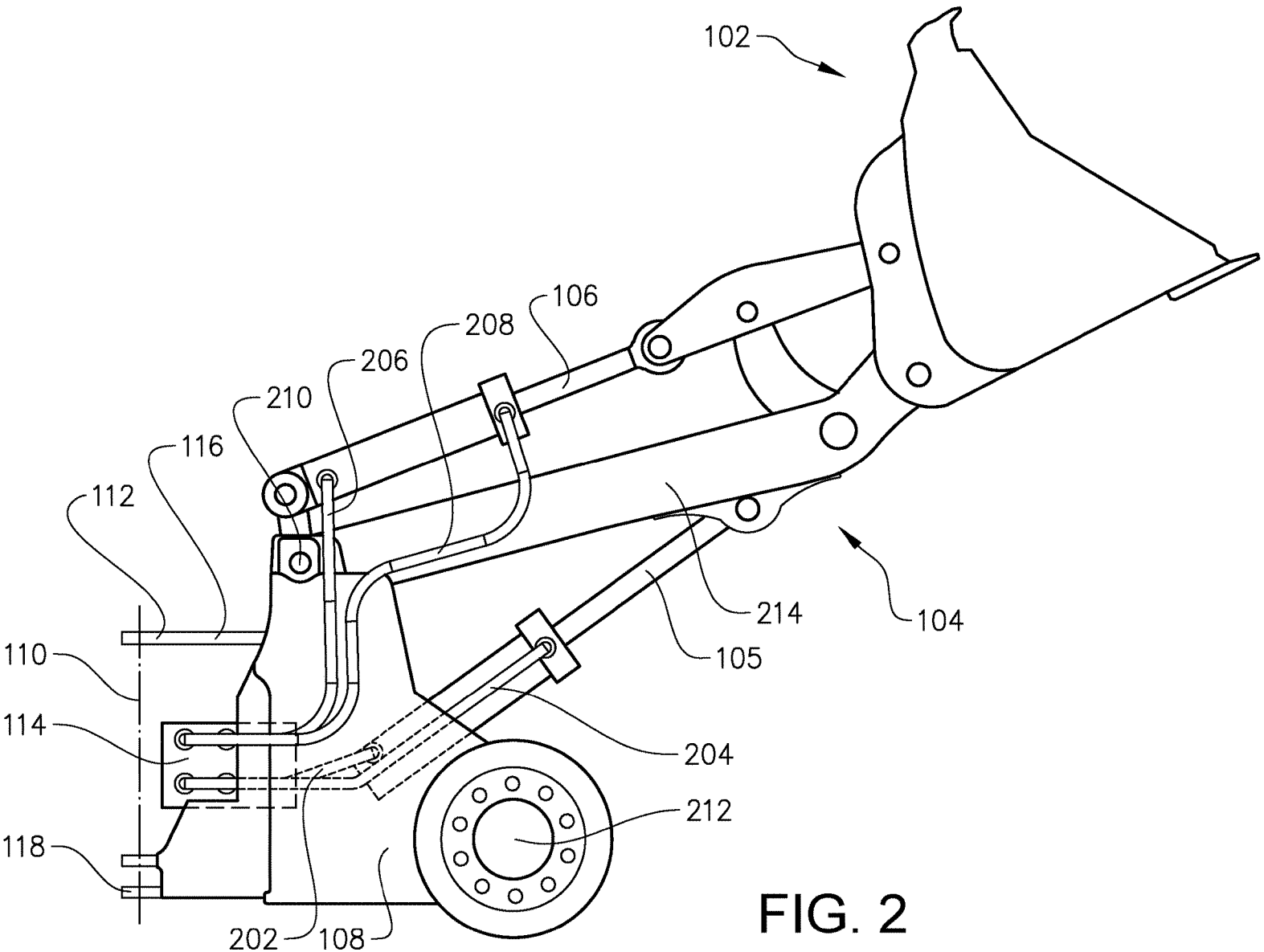
FIG. 2 is a side view of an example embodiment of a front unit of the loader vehicle depicted in FIG. 1.
Figure 3:
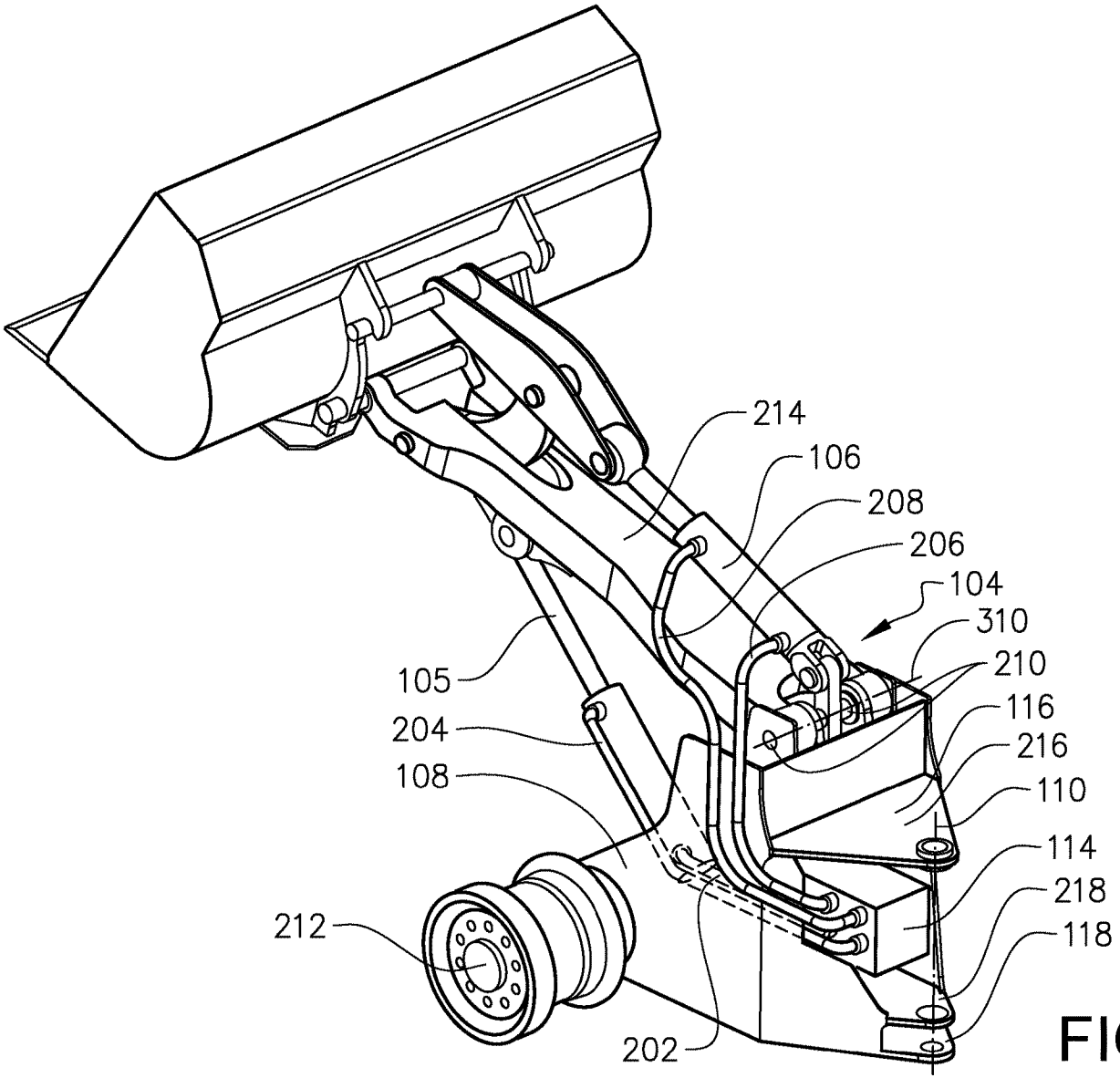
FIG. 3 is perspective view of the front unit depicted in FIG. 2.

Now, reference is made to FIGS. 2 and 3 which illustrate the control valve arrangement 114 in further detail. As depicted in FIGS. 2 and 3, the control valve arrangement 114 is arranged at the rear portion of the front unit 108 in the vicinity of the articulated joint arrangement 112. In detail, the articulated joint arrangement 112 comprises an upper 116 and a lower 118 attachment point on the rear portion of the front unit 108. The attachment points 116, 118 are constituted by respective upper 216 and lower 218 structural flanges of the front unit 108 according to the example embodiment depicted in the figures. Likewise, although not depicted in FIGS. 2 and 3, the rear unit 109 also comprises attachment flanges such that the attachment flanges of the front 108 and rear 109 units are connected to each other to form the articulated joint arrangement 112. The control valve arrangement 114 is arranged between the upper 116 and lower 118 attachment points as seen in the vertical direction of the loader vehicle 101. Furthermore, and as depicted in FIG. 3, the control valve arrangement 114 is also arranged at a substantially centre position of the loader vehicle 101 as seen in the transversal direction thereof. In detail, the control valve arrangement 114 is arranged at a transversal position between the wheels of the loader vehicle 101 such that portions of the control valve arrangement 114 is arranged on respective transversal sides of a geometric plane extending in the vertical and longitudinal direction of the loader vehicle 101 and located at a centre position of the loader vehicle 101. As also depicted in FIGS. 2 and 3, the control valve arrangement 114 is at least partially housed within the front unit 108. More particularly, the control valve arrangement 114 is at least partly housed in the frame section of the front unit 108 by means of the upper 216 and lower 218 attachment flanges as well as part of a vertical frame section of the front unit 108. The rear portion of the control valve arrangement 114 is however not housed within the frame section of the front unit 108 in order to improve the accessibility thereof. Hereby, the control valve arrangement 114 can be protected from external damage. For example, a structure of the upper 116 and lower 118 attachment points can protect the control valve arrangement 114 from damage that may accidentally occur from being hit from above or below the loader vehicle 101. The frame section of the rear portion of the front unit 108 can protect the control valve arrangement 114 front damage caused b hits from the side of the loader vehicle 101. Hence, the control valve arrangement 114 is protected from e.g. stones flying up from the road, etc.

The control valve arrangement 114 is arranged to hydraulically control the loading unit assembly 104 of the loader vehicle 101. The control valve arrangement 114 is thus connected to a hydraulic pump (not shown) for receiving hydraulic fluid in order to lift, lower, and tilt the implement 102 of the loading unit assembly 104, In detail, the control valve arrangement 114 is connected to the lift cylinder 105*a* by means of lift conduits 202, 204, and to the tilt cylinder 106 by means of tilt conduits 206, 208, Further details regarding the connections between the control valve arrangement 114 and the lift/tilt cylinders will be given below with reference to FIG. 4.

Furthermore, the loading unit assembly 104 is connected to the front frame of the front unit 108 by means of at least one lift arm joint arrangement 210, The loading unit assembly 104 is thus able to rotate around a substantially horizontal axis 310 constituted by the at least one lift arm joint arrangement 210 during lifting and lowering of the implement 102 relative to the ground. The control valve arrangement 114 is in the example embodiment depicted in FIGS. 2 and 3 arranged behind the at least one lift arm joint arrangement 210 when seen in the forward driving direction of the loader vehicle 101.

Still further, the front unit 108 comprises a pair of individually controlled propulsion motors 212. Hereby, the ground engaging members 120 of the front unit 108 are individually controlled by a respective propulsion motor 212. The individual propulsion motors 212 may be wheel hub motors.

Moreover, the loading unit assembly 104 comprises a single boom lift arm 214, which is illustrated in detail in FIG. 3. The single boom lift arm 214 is preferably arranged at a central position of the front unit 108 as seen in the transversal direction of the loader vehicle 101. As seen in FIG. 3, the lift cylinder 105*a* is arranged straight below the single boom lift arm 214 and hence also arranged at the central position of the front unit 108 as seen in the transversal direction of the loader vehicle 101.

Figure 4:
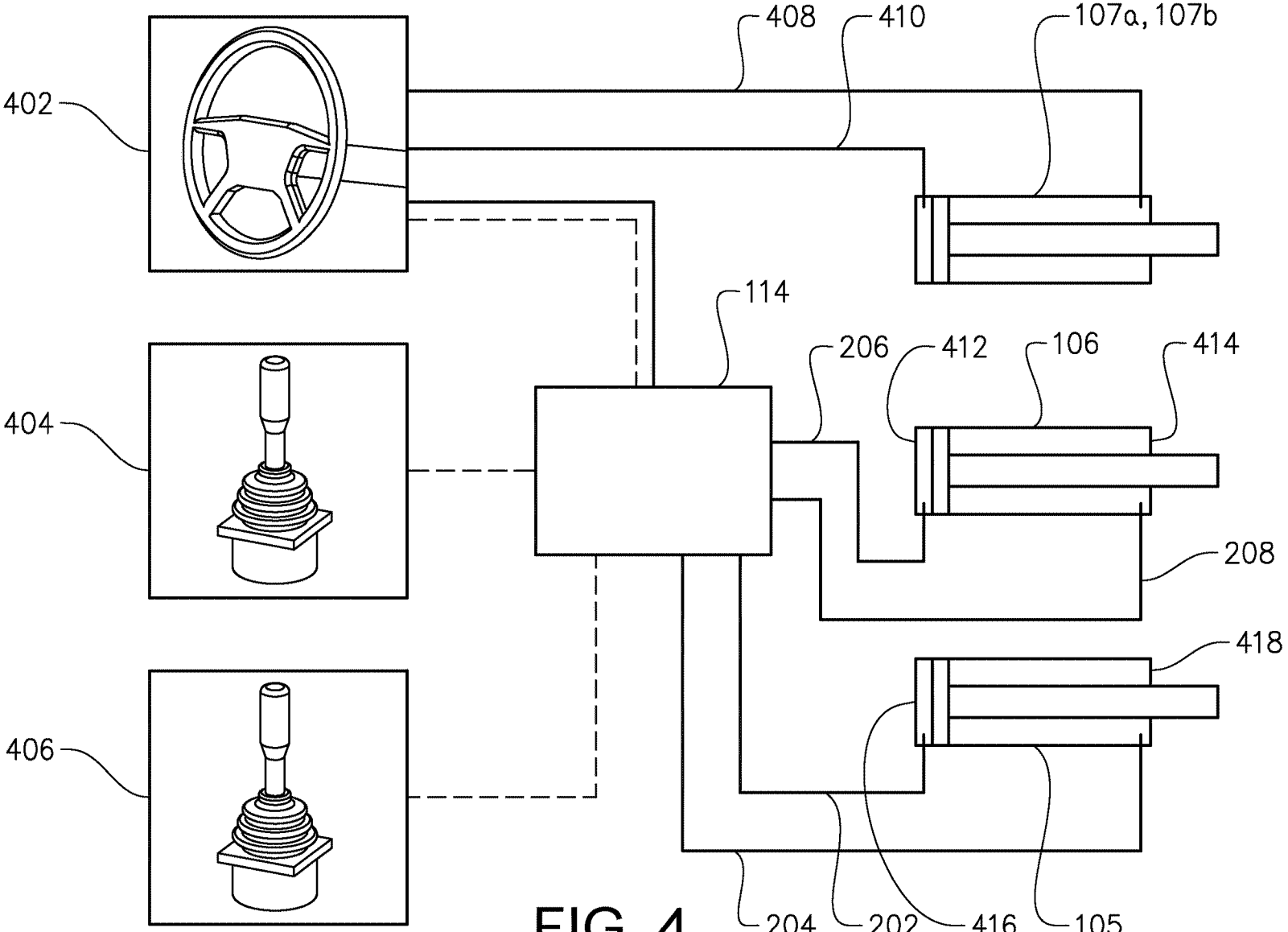
FIG. 4 is schematic view illustrating the control valve arrangement according to an example embodiment.

Reference is now made to FIG. 4 which is a schematic view illustrating the control valve arrangement 114 according to an example embodiment. As illustrated, the control valve 114 is connected to the steering wheel 402, a tilt manoeuvre device 404 and a lift manoeuvre device 406, The tilt manoeuvre device 404 and the lift manoeuvre device 406 are in the embodiment of FIG. 4 illustrated as respective levers. The control valve arrangement 114 thus receives control signals from the steering wheel 402, the tilt manoeuvre device 404 and the lift manoeuvre device 406. It should be readily understood that steering of the loader vehicle 101 may also be accomplished by means of a lever instead of the depicted steering wheel.

Furthermore, the steering wheel 402 is connected to the steering cylinders 107*a*, 107*b* of the loader vehicle 101. Hence, when the operator of the loader vehicle turns the steering wheel 402, hydraulic fluid is provided through steering cylinder conduits 408, 410 such that the pistons of the steering cylinders 107*a*, 107*b* extends/retracts for turning the loader vehicle. Hereby, the front 108 and rear 109 units of the loader vehicle 101 are rotated relative to each other around the substantially vertical geometric axis 110.

Moreover, when the operator of the loader vehicle 101 controls the tilt manoeuvre device 404, the control valve arrangement 114 controls hydraulic fluid to be delivered to the tilt cylinder 106 for tilting the implement 102 of the loader vehicle 101. In detail, hydraulic fluid is delivered through the tilt conduits 206, 208 to either a piston side 412 or a piston rod side 414 of the tilt cylinder 106.

On the other hand, when the operator of the loader vehicle 101 controls the lift manoeuvre device 406, the control valve arrangement 114 controls hydraulic fluid to be delivered to the lift cylinder 105*a* for lifting or lowering the loading unit assembly 104, In detail, hydraulic fluid is delivered through the lift conduits 202, 204 to either a piston side 416 or a piston rod side 418 of the lift cylinder 105*a*.

It is to be understood that the present invention is not limited to the embodiments described above and illustrated in the drawings; rather, the skilled person will recognize that many changes and modifications may be made within the scope of the appended claims. For example, the tilt maneuver device 404 and the lift maneuver device 406 may be one and the same maneuver device.

The invention claimed is:

1. A loader vehicle comprising:

a front unit and a rear unit pivotally connected to each other by an articulated joint arrangement allowing mutual rotation of the front unit and the rear unit; and a loading unit assembly and a control valve arrangement arranged to hydraulically control the loading unit assembly, wherein the control valve arrangement is arranged at a rear portion of the front unit in the vicinity of the articulated joint arrangement, wherein the articulated joint arrangement comprises an upper and a lower attachment point at the rear portion of the front unit, wherein the attachment points are constituted by respective upper and lower structural flanges of the front unit, wherein the control valve arrangement is arranged between the upper and lower attachment points, as seen in a vertical direction of the loader vehicle, and wherein the control valve arrangement is partly housed within a frame section of the front unit by means of the upper and lower structural flanges as well as part of a vertical frame section of the front unit, such that a rear portion of the control valve arrangement is not housed within the frame section of the front unit.

2. A loader vehicle according to claim 1, wherein the loading unit assembly is connected to the front unit by means of at least one lift arm joint arrangement, wherein at least a portion of the control valve arrangement is arranged behind the at least one lift arm joint arrangement as seen in the forward driving direction of the loader vehicle.

3. A loader vehicle according to claim 2, wherein the complete control valve arrangement is arranged behind the at least one lift arm joint arrangement as seen in the forward driving direction of the loader vehicle.

4. A loader vehicle according to claim 2, wherein the articulated joint arrangement constitutes a substantially vertical geometric axis for allowing mutual rotation of the front unit and the rear unit, and wherein at least a portion of the control valve arrangement is arranged between the at least one lift arm joint arrangement and the substantially vertical geometric axis as seen in the longitudinal direction of the loader vehicle.

5. A loader vehicle according to claim 4, wherein the complete control valve arrangement is arranged between the at least one lift arm joint arrangement and the substantially vertical geometric axis as seen in the longitudinal direction of the loader vehicle.

6. A loader vehicle according to claim 2, wherein the lift arm joint arrangement comprises at least one substantially horizontal axis, wherein the loading unit assembly is configured to rotate about the substantially horizontal axis to move the loading unit assembly between the raised position and the lowered position, and wherein the complete control valve arrangement is arranged entirely behind the at least one substantially horizontal axis as seen in the forward driving direction of the loader vehicle.

7. A loader vehicle according to claim 1, wherein the articulated joint arrangement constitutes a substantially vertical geometric axis for allowing mutual rotation of the front unit and the rear unit.

8. A loader vehicle according to claim 1, wherein the loading unit assembly is arranged at a front portion of the front unit.

9. A loader vehicle according to claim 1, wherein the loading unit assembly comprises a single boom lift arm.

10. A loader vehicle to claim 9, wherein the single boom lift arm is arranged at a substantially central position of the front unit as seen in the transversal direction of the loader vehicle.

11. A loader vehicle according to claim 1, wherein the loading unit assembly comprises at least one lift cylinder and at least one tilt cylinder for controlling motions of an implement of the loading unit assembly.

12. A loader vehicle according to claim 1, wherein the loader vehicle comprises a power source for propelling the loader vehicle, wherein the power source is arranged on the rear unit of the loader vehicle.

13. A loader vehicle according to claim 1, wherein the front unit comprises a pair of ground engaging members, the ground engaging members each comprising an individually controlled propulsion motor.

14. A loader vehicle according to claim 13, wherein the individually controlled propulsion motors are electric propulsion motors.

15. A loader vehicle according to claim 13, wherein the individually controlled propulsion motors are individual wheel hub motors.

16. A loader vehicle according to claim 1, wherein the loader vehicle comprises a plurality of cylinders being connected to the control valve arrangement via conduits, each conduit being connected to the control valve arrangement at a connection point such that a plurality of connection points is formed between the control valve arrangement and the conduits, wherein at least one of the connection points is not housed within the frame section of the front unit.

* * * * *